US007500572B2

(12) United States Patent
Lane et al.

(10) Patent No.: US 7,500,572 B2
(45) Date of Patent: Mar. 10, 2009

(54) HIGH SECURITY DISPLAY SYSTEM FOR FIREARMS

(76) Inventors: Woodrow W. Lane, 2351 Lonestar Dr., Norco, CA (US) 92860; Kenneth M. Lane, 2504 Palomino Dr., Covina, CA (US) 91724

( * ) Notice: Subject to any disclaimer, the term of this patent is extended or adjusted under 35 U.S.C. 154(b) by 470 days.

(21) Appl. No.: 10/953,569

(22) Filed: Sep. 28, 2004

(65) Prior Publication Data

US 2005/0218021 A1 Oct. 6, 2005

Related U.S. Application Data

(60) Provisional application No. 60/506,693, filed on Sep. 29, 2003.

(51) Int. Cl.
*A47F 7/00* (2006.01)

(52) U.S. Cl. ..... 211/64

(58) Field of Classification Search ..... 211/4, 211/64; 248/551; 70/16, 62, 58
See application file for complete search history.

(56) References Cited

U.S. PATENT DOCUMENTS 2,158,623 A * 5/1939 Fischbacher ..... 312/6
4,018,339 A * 4/1977 Pritz ..... 211/8
4,132,315 A 1/1979 Young
4,174,042 A * 11/1979 Fair ..... 211/8
4,949,559 A * 8/1990 Glines ..... 70/19
5,138,852 A 8/1992 Corcoran
5,265,950 A * 11/1993 Atkinson ..... 312/216
5,579,923 A 12/1996 Hemmerlein
5,887,730 A 3/1999 St. George
6,427,497 B1 * 8/2002 Mossberg et al. ..... 70/18
6,619,082 B1 * 9/2003 Bentley ..... 70/58
6,868,975 B2 * 3/2005 Sells et al. ..... 211/4

* cited by examiner

*Primary Examiner*—Sarah Purol
(74) *Attorney, Agent, or Firm*—Merchant & Gould P.C.

(57) ABSTRACT

An apparatus for securely storing a plurality of firearms has multiple options for locking arms while displaying the firearms. A gang locking system includes first lock members associated with each firearm. The first lock members shift between a locked position and an unlocked position to control access to all firearms in a cabinet. A common actuator shifts each of the first lock members upon actuation by an operator. An individual locking system includes a plurality of second lock members. The second lock members control individual ones of the firearm locks.

12 Claims, 16 Drawing Sheets

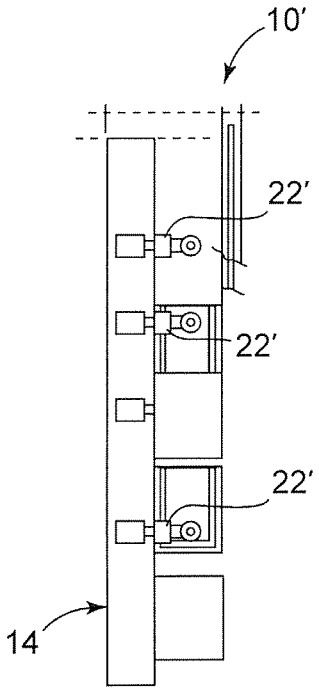
FIG. 11
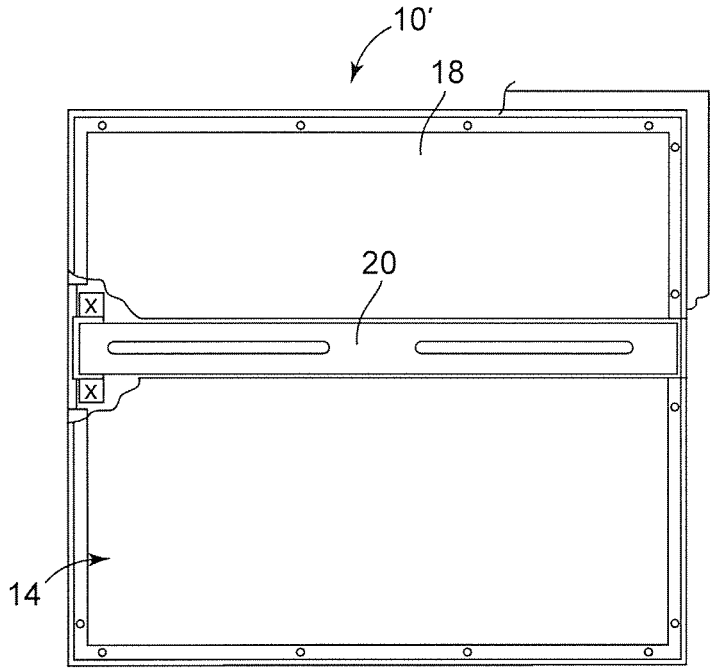
FIG. 12
FIG. 13
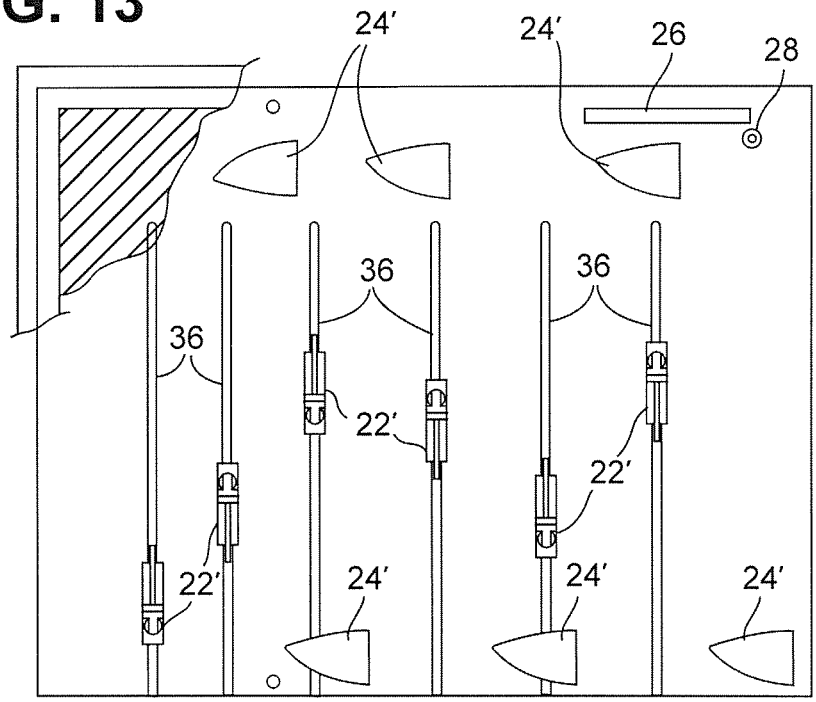

HIGH SECURITY DISPLAY SYSTEM FOR FIREARMS

I. CROSS-REFERENCE TO RELATED APPLICATIONS

This patent application claims priority to U.S. Provisional Patent Application Ser. No. 60/506,693 filed Sep. 29, 2003 in the names of Woodrow Wilson Lane and Kenneth Michael Lane.

II. BACKGROUND OF THE INVENTION

1. Field of the Invention

This invention pertains to an apparatus for storing firearms. More particularly, this invention pertains to an apparatus for storing and displaying firearms in a manner providing multiple locking opportunities to secure firearms within the apparatus.

2. Description of Prior Art

Many owners of firearms prefer to display their firearm collection in their homes or businesses. Firearm display cabinets are available from a wide variety of sources and come in a wide variety of styles. These include inexpensive pine wood cabinets as well as exquisite, high quality, furniture-grade hardwood and glass systems. The primary function of traditional display cabinets is to provide an attractive display of an owner's firearm collection. Such cabinets provide only minimal security, which may include tempered glass and a low security lock.

Due to crime and concerns over child safety, increased attention has been placed on firearm security. Indeed, some jurisdictions legislate requirements for firearm safety. Legislative required storage may include metal safes or gun boxes. These are highly secure but sacrifice a visible and attractive display of a firearm collection.

It is an object of the present invention to provide a highly secure storage for firearms while permitting their attractive display. The present invention provides a secure system for storing firearms with or without a surrounding cabinet. The present invention accommodates a wide range of firearm types including rifles, shotguns, revolvers and semi-automatic pistols or other handguns. The design is adaptable to a wide variety of calibers or bore sizes.

III. SUMMARY OF THE INVENTION

An apparatus is disclosed for securely storing a plurality of firearms. The apparatus includes a plurality of firearm braces. These include muzzle end braces to capture a muzzle end of a firearm and user end braces adapted to capture a user end (e.g., rifle butt or pistol grip) of a firearm. At least one of the user end brace and the muzzle end brace of each of an associated pair of braces is a locking brace shiftable between a capture state and a disengage state. In the capture state, the locking brace engages a firearm in a manner to resist movement of the firearm from a storage pathway. In the disengage state, the locking brace permits movement of the firearm from the storage pathway.

In one embodiment, the present invention includes two alternative locking systems: one for gang locking all firearms in a cabinet and the other for individually locking firearms. Other embodiments include the gang locking alone or the individual locking alone.

The gang locking includes a plurality of first lock members associated with each of the locking braces. Each of the first lock members shifts between a locked position and an unlocked position. In the locked position, the first lock member is engaged with the locking brace to interfere with its shifting from the capture state to the disengage state. In the unlocked position, the first lock member is positioned to permit shifting of the locking brace. A common actuator shifts each of the first lock members upon actuation by an operator.

The individual locking includes a plurality of second lock members associated with each of the locking braces. Each of the second lock members moves between a locked state and an unlocked state. In the locked state, the second lock member is engaged with the locking brace to interfere with its shifting. In the unlocked state, the second lock member is positioned to permit shifting of the locking brace.

IV. BRIEF DESCRIPTION OF THE DRAWINGS

FIG. 11 is a side elevation view of the apparatus of FIG. 10;

FIG. 12 is a rear elevation view of the apparatus of FIG. 10;

FIG. 13 is a front elevation view of an alternative embodiment of the apparatus of FIG. 10 shown to accommodate six handguns;

V. DETAILED DESCRIPTION OF THE PREFERRED EMBODIMENT

With reference now to the various drawing figures in which identical elements are numbered identically throughout, a description of the preferred embodiment of the present invention will now be provided.

Figure 1:
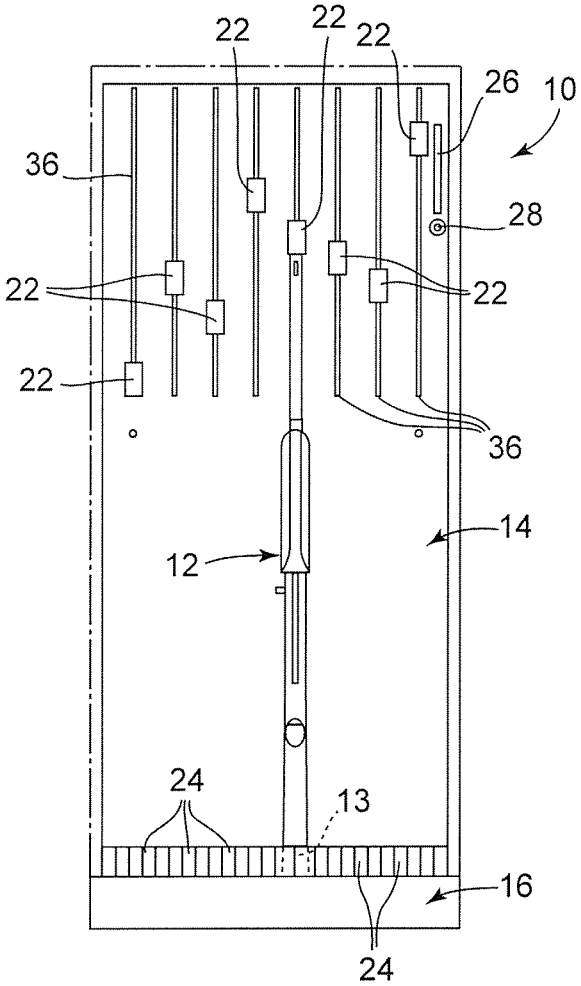
FIG. 1 is a front elevation view of a secure display apparatus according to the present invention and shown in an embodiment for receiving and storing eight rifles (with only one rifle shown in FIG. 1 for the purpose of clarity)
Figure 2:
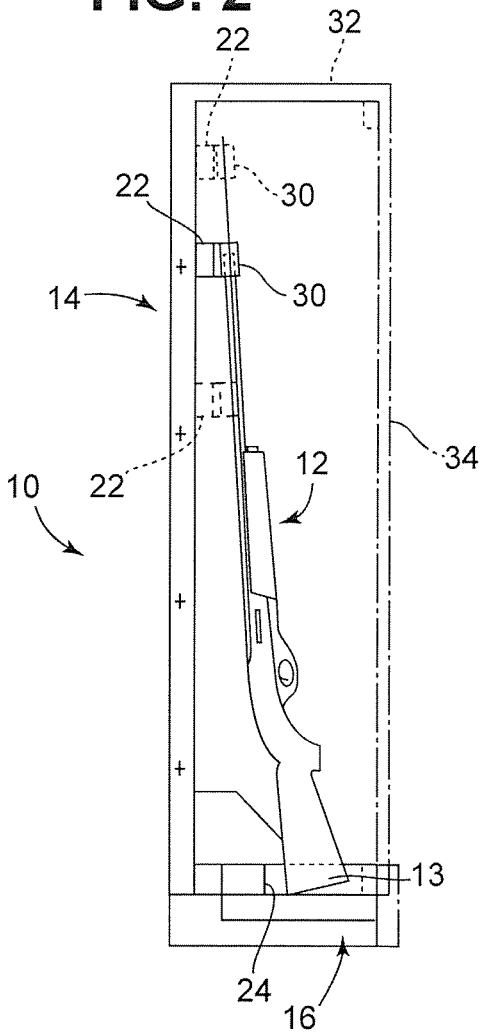
FIG. 2 is a side elevation view of the apparatus of FIG. 1 and showing, in phantom lines, a muzzle bracket in alternate positions to accommodate firearms of different lengths.
Figure 3:
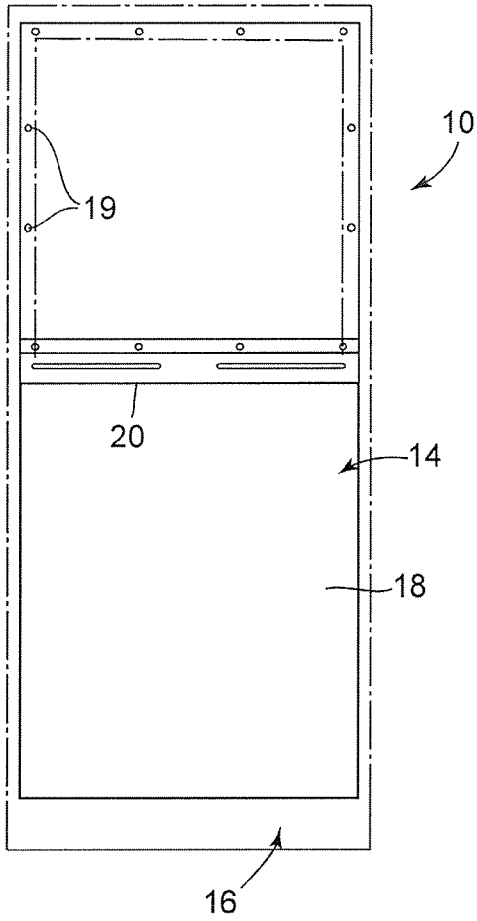
FIG. 3 is a rear elevation view of the apparatus of FIG. 1.

With initial reference to FIGS. 1-3, the apparatus of the present invention is shown in the preferred embodiment as a cabinet 10 for receiving a plurality of firearms 12. In FIGS. 1-3, the firearm 12 is represented by a rifle or shotgun.

As will become apparent, the present invention can handle a wide variety of firearms (for example, rifles, shotguns as well as handguns, all of various lengths and construction). Therefore, for ease of description, the term "firearm" is meant to include rifles, shotguns, handguns, carbines as well as multiple barreled firearms in various geometries (for example, over-and-under and side-by-side barrel geometries). Also, for ease of description, the term "muzzle end" is used herein to mean the discharge end of a firearm. The term "user end" shall mean the end of the firearm opposite the muzzle end and shall include the butt of a rifle or shotgun and the grip of a handgun.

As shown in FIGS. 1-3, the cabinet 10 includes a rear housing 14 for housing locking mechanisms as will be described. The cabinet 10 further includes a base member 16. Preferably, a rear wall of the cabinet includes a metal rear cover 18 which is secured to the rear housing 14 by tamper resistant fasteners 19 to prevent unauthorized access into the locking mechanisms contained within the housing 14. A wall-mounting bracket 20 is provided to securely fasten the rear housing 14 to the wall studs or other structural members of a home, office or other structure. The apparatus of the present invention can be mounted on a pedestal, tabletop or mounted on a wall.

The wall-mounting bracket 20 may be fastened to a structure (i.e., wall studs of a house) by any suitable means. The rear housing 14 can then be fastened to the wall-mounting bracket 20 through any suitable means (e.g., by tamper resistant fasteners accessible through holes (not shown) formed through the front of the rear housing 14). With this assembly, the cabinet 10 resists theft of the entire cabinet 10.

Cabinet 10, as shown in FIGS. 1-3, is configured to receive eight firearms in side-by-side relation and in parallel, vertical orientation. However, only one such firearm 12 is shown for ease of illustration. The particular cabinet of FIG. 1 has a height sized to accommodate a wide variety of different lengths of firearms.

The cabinet includes a plurality of firearm braces which may also be conveniently referred to as brackets. These include a plurality of muzzle end braces 22 and user end braces 24. The muzzle end braces 22 are adapted to capture the muzzle end of a firearm. The user end braces 24 are adapted to capture the user end of the firearm (the butt end 13 of the rifle 12 in the embodiment of FIGS. 1 and 2).

As shown in FIGS. 1 and 2, the user end braces 24 are shown as individual pockets formed in the base member 16. Each pocket is sized to receive the butt 13 of one rifle 12.

As illustrated in FIG. 1, aligned pairs of the muzzle end braces 22 and user end braces 24 define a plurality or associated pairs of firearm braces. Each of these associated pairs defines a firearm storage site, which is the linear pathway between the aligned muzzle end brace 22 and user end brace 24.

As will be described, at least one of the user end brace 24 and muzzle end brace 22 of an associated pair is a locking brace which is shiftable between a capture state and a disengage state. In the capture state, the locking brace engages a firearm in the storage pathway in a manner to resist movement of the firearm from the storage pathway. In the disengage state, the locking brace permits movement of the firearm from the storage pathway.

In a preferred embodiment as described in the present application, only the muzzle end brace 22 is a locking brace shiftable between a capture state and a disengage state. However, it will be appreciated that the design of the present invention could be modified such that the user end brace is a locking brace.

As shown in FIG. 1, a handle 26 is provided on the rear housing 14. Operation of the handle 26 by an operator acts to lock or unlock all of the muzzle braces in a manner that will be described. A key lock 28 is provided for permitting use of the handle 26 only after entry and operation of an authorized key within the key lock 28.

As shown in FIG. 2, the locking brace (i.e., the muzzle brace 22) is moveable in a linear direction parallel with the storage site direction to accommodate various lengths of weapons or firearms. Further, in the embodiment of FIG. 2, a muzzle cup 30 is pivotally connected to the muzzle brace to pivot about an axis perpendicular to the direction of the storage site to accommodate different lengths of firearms and to permit removal of a firearm as will be described.

FIG. 2 shows, in phantom lines, additional cabinetry detail including a top wall 32 and a front wall 34. The walls 32, 34 may be wood, glass or any other ornamental design to permit the cabinet 10 to present an ornamental display of the contained firearms.

As shown in FIG. 1, each of the muzzle braces 22 extends through a linear slot 36 formed in the housing 14 such that a portion of the muzzle brace 22 resides within the interior of the housing 14. As a result, the muzzle braces 22 may be moved along the linear direction of the slots 36. The slots 36 are aligned with the storage paths of the firearms 12 to accommodate various lengths of firearms and to permit removal of a firearm as will be described.

Figure 9:
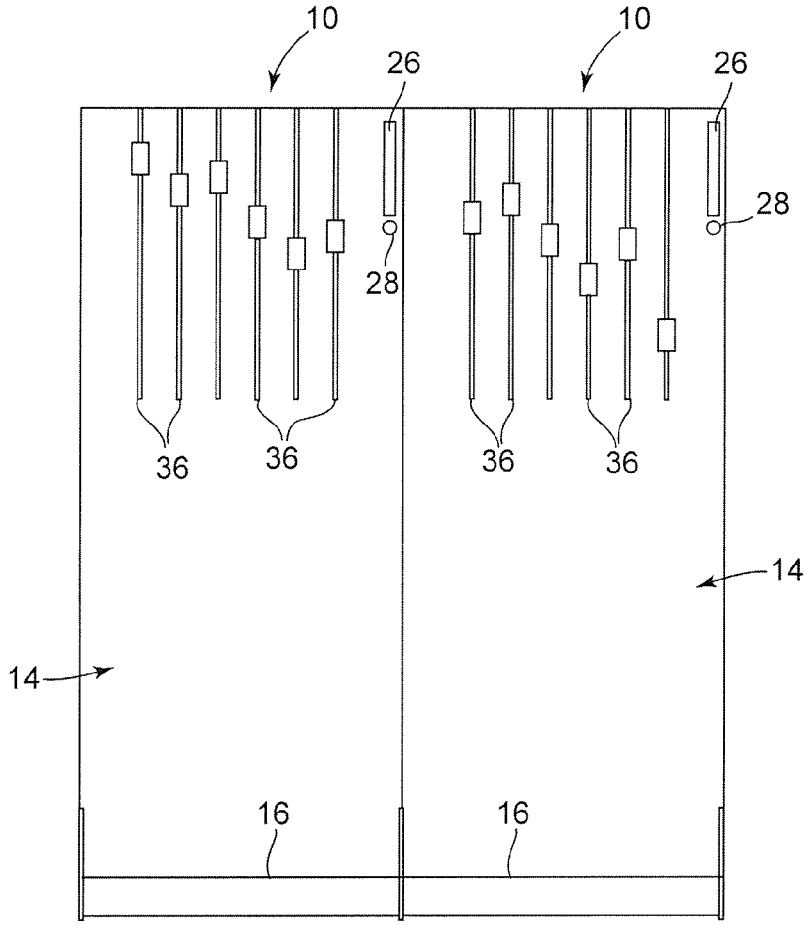
FIG. 9 is an alternative embodiment showing two of the apparatus of FIG. 1 each configured to accommodate six rifles and shown connected in side-by-side relation to accommodate twelve firearms.

FIG. 9 shows an embodiment where a cabinet 10 such as that shown in FIG. 1 is provided with only six slots 36 for receiving six firearms. Two such cabinets 10 are placed side-by-side to present twelve slots 36 for twelve firearms. It will be appreciated that cabinet modules for four, six, eight or ten or more firearms are possible and that such cabinets can be placed side-by-side as a firearm collection increases in number and variety.

Before proceeding with a detailed description of the locking mechanisms of the present invention, alternative embodiments of the cabinet of the present invention will now be described. FIGS. 4-8 show an alternative embodiment of the cabinet (with similar elements being identically numbered to those in FIGS. 1-3 with addition of apostrophes to distinguish embodiments).

Figure 8:
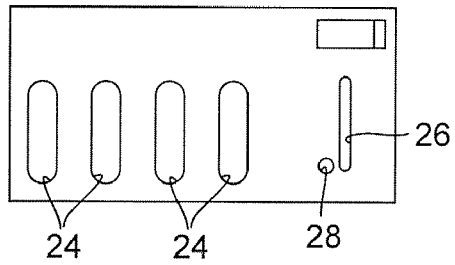
FIG. 8 is a view taken along line 8-8 of FIG. 4.

The cabinet 10' of FIG. 4 includes four storage sites for receiving a rifle or shotgun in the manner identical to that described with reference to FIG. 1. User end braces 24 are received within a floor as illustrated in FIG. 1, the user end braces 24 (or butt pockets) are received on a base member 16 which is supported by a gusset 40. The lock handle 26 and key lock 28 are positioned on the base member 16. Comparing FIGS. 2 and 5, it will be noted the firearm is rotated 180 degrees illustrating optional storage options. Also, the lower pockets or braces 24 as shown in FIG. 8 could be rotated 45 degrees to permit a storage option with the firearm rotated 45 degrees from that of FIG. 1 permitting an option of displaying a side of the firearm.

Figure 14:
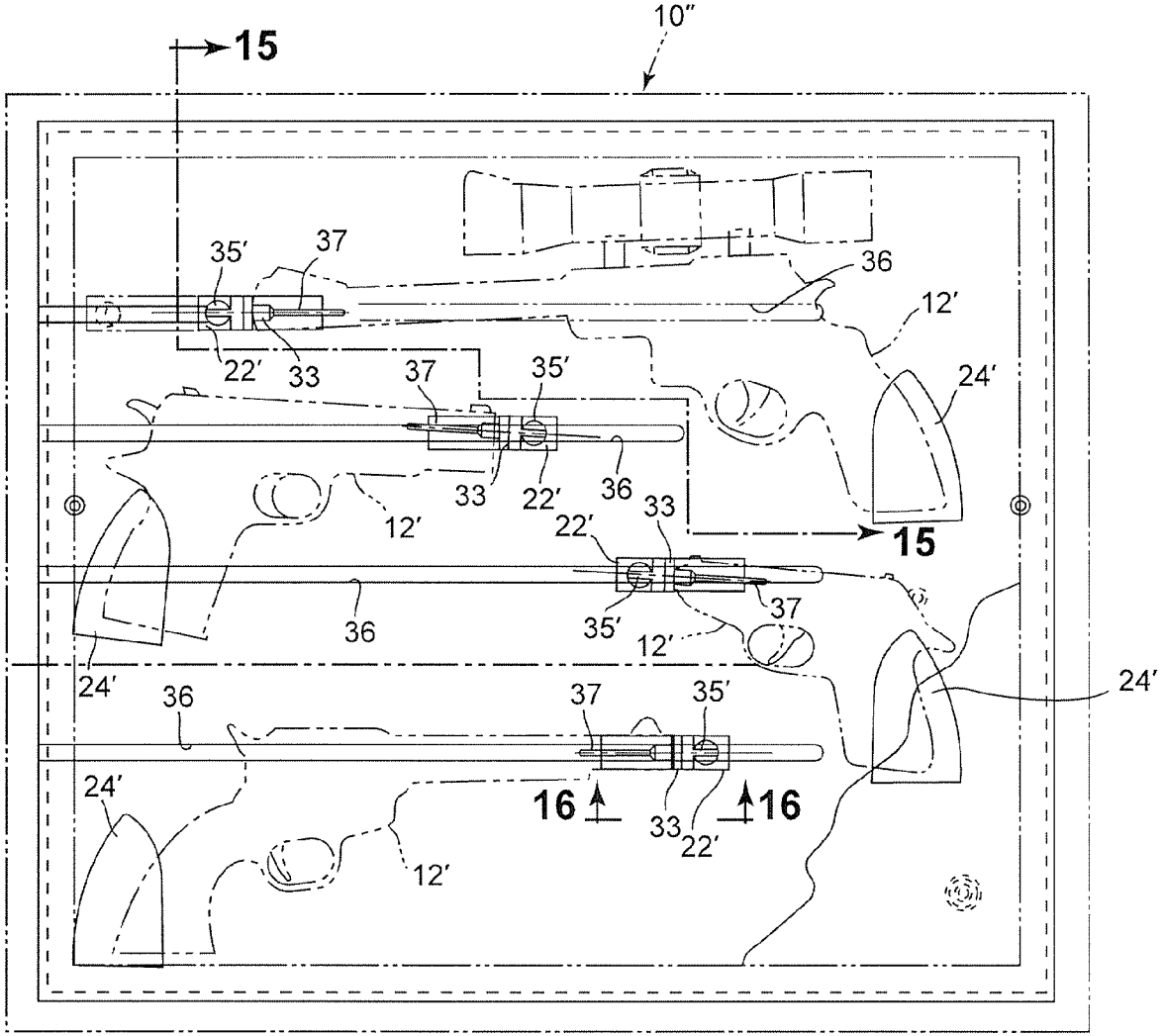
FIG. 14 is a front elevation view of an apparatus such as that of FIG. 10 and showing, in phantom lines, four various designs of handguns stored in the apparatus.
Figure 18:
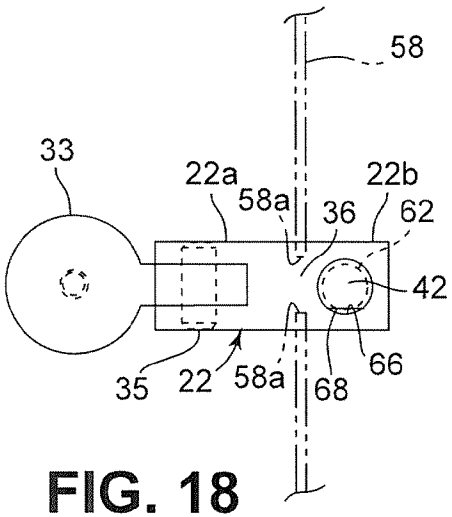
FIG. 18 is a top plan view of the mounting bracket and shaft of FIG. 17.

In addition to accommodating storage of four rifles or shotguns, the cabinet 10' of FIGS. 4-7 may securely store a plurality of handguns (shown in phantom lines). The handguns 12' have a user end in the form of a grip 13', which is received within a user end brace 24'. The user end brace 24' is in the form of a cup securely fastened to the housing 14. Two such cups 24' are shown in FIG. 14 and a third such cup can be formed in the base member to receive a third handgun if desired.

For securely capturing the handgun 12', a universal pivoting muzzle end brace 22' is provided which can pivot in multiple directions for reasons that will be apparent. Also, the brace 22' may be positioned in the slot 36 to accommodate various lengths of handguns. All of the pistol muzzle braces 22' are contained within a common slot 36.

Figure 4:
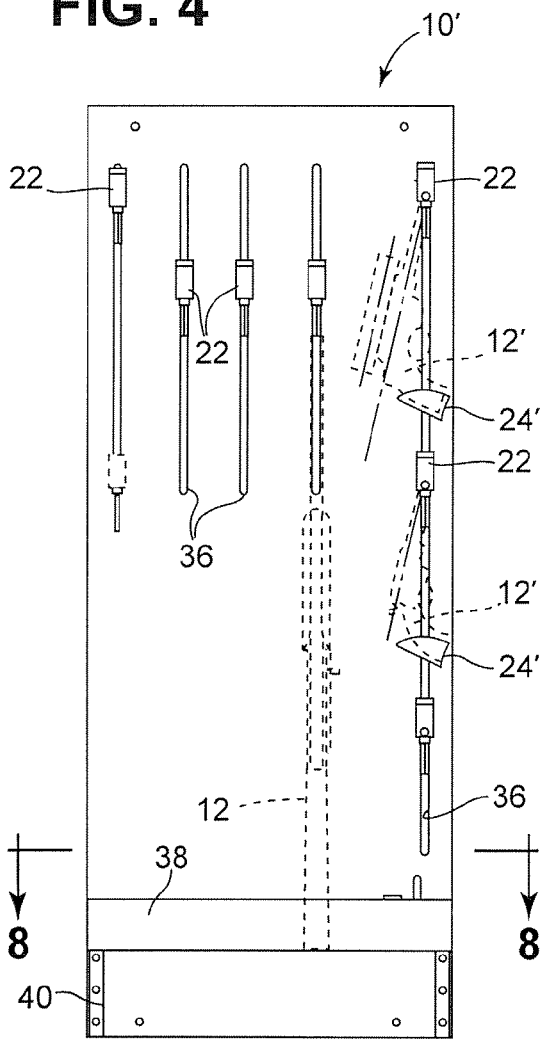
FIG. 4 is a front elevation view of an alternate embodiment of the apparatus of FIG. 1 and showing an apparatus for storing four rifles and multiple handguns.
Figure 5:
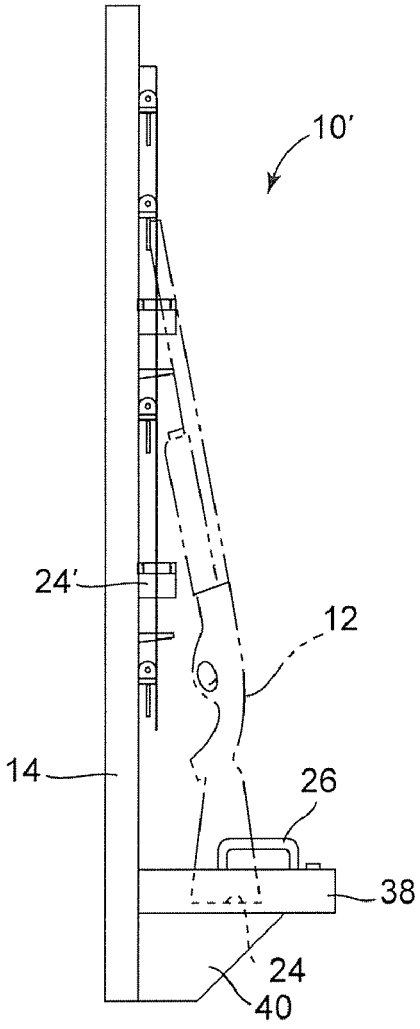
FIG. 5 is a side elevation view of the apparatus of FIG. 4.
Figure 6:
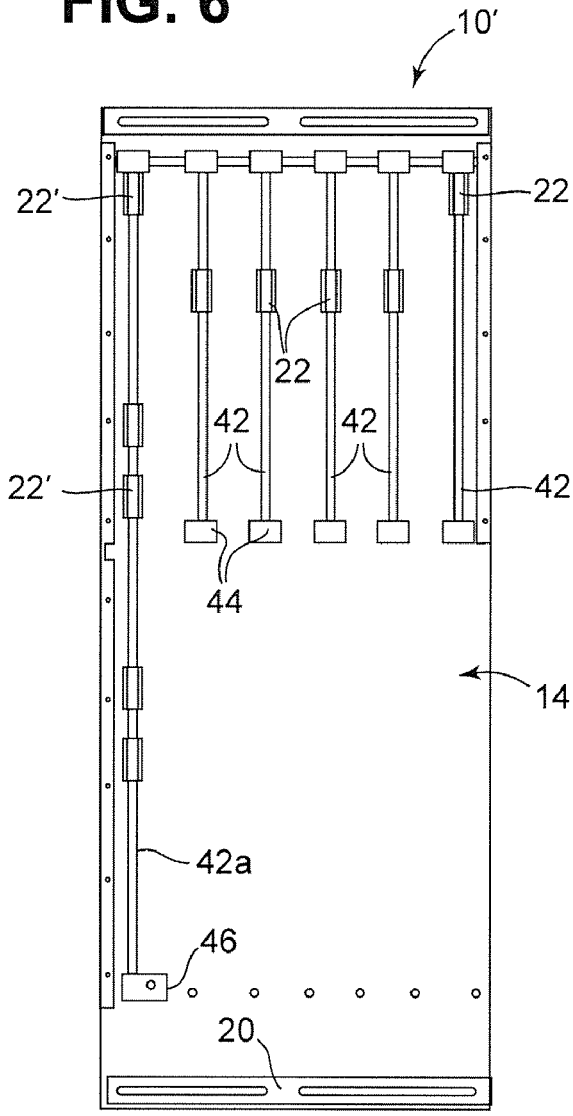
FIG. 6 is a rear elevation view of the apparatus of FIG. 4 and with rear panels removed to expose interior elements.
Figure 7:
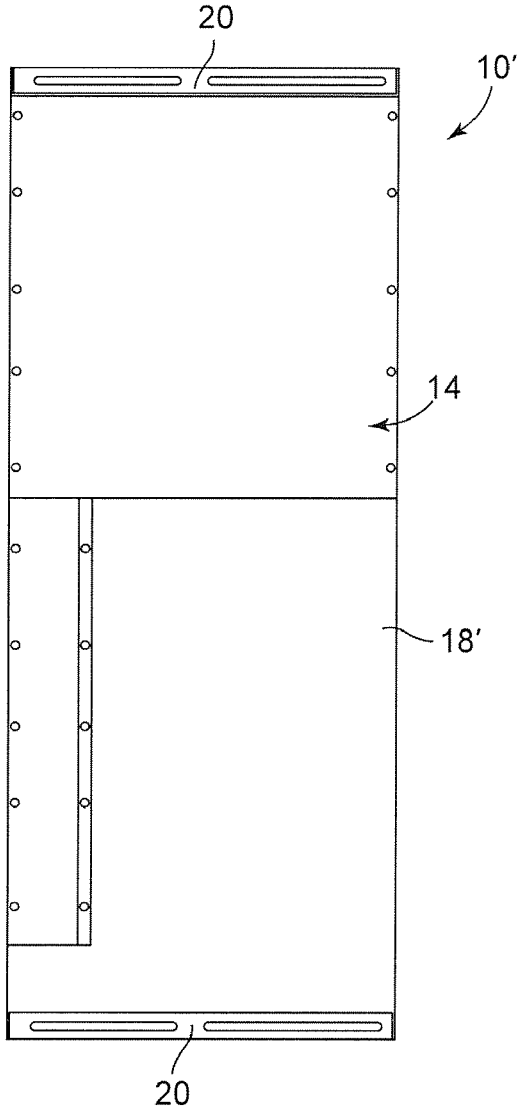
FIG. 7 is the view of FIG. 6 with a rear panel in place to cover interior elements.

FIG. 6 shows the cabinet 10' of FIG. 4 in a rear view with a rear cover 18' removed to expose interior elements. As shown in FIG. 6, a plurality of first lock members are engaged with individual muzzle end braces 22. The first threaded lock members include a threaded rod 42 mounted in upper and lower brackets 44 such the threaded rods 42 are positioned in parallel alignment and behind each of the slots 36 with the threaded rods 42 completely contained within the interior of the rear housing 14.

The muzzle end braces 22, 22' are individually mounted on each of the threaded rods 42. A longer threaded rod **42*a* is provided behind the elongated slot for the multiple handguns. The handgun muzzle end braces 22' are carried on the single elongated threaded rod 42*a***.

The bottom end of the threaded rod **42*a* is contained within a mounting bracket 46. The bracket 46 is coupled to the handle 26 such that raising the handle 26** causes rotation the rod about its longitudinal axis. It will be appreciated that linkage for such rotation is well within the skill of the art. It will also be appreciated that while a handle is shown for actuating the locking systems described herein and throughout this application, such actuation need not be hand activated but could be power actuated or remotely activated.

Each of the threaded rods 42, **42*a* is mounted within the brackets 44 for the rods to pivot about their longitudinal axes. The upper brackets connect each of the rods through a linkage system (e.g., a rack and pinion gear system shown in FIG. 6) such that rotation of the elongate threaded rod 42*a* results in simultaneous and equivalent angular rotation of all threaded rods 42. Alternative linkage systems can be used and an example of such an alternative will later be described with reference to FIGS. 37-40**.

Figure 10:
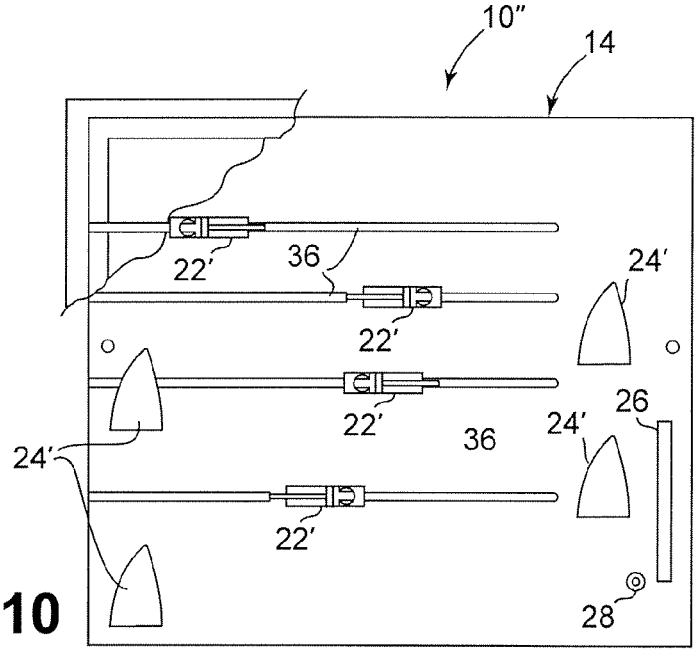
FIG. 10 is a front elevation view of a further embodiment of the present invention adapted to store and display four handguns.

In all the embodiments of FIGS. 1-8, the cabinet 10, 10' has been shown to mount firearms in a storage pathway that is vertically aligned. FIGS. 10-13 show an alternative embodiment for mounting firearms in a horizontal storage pathway. This is the preferred pathway to ornamentally display a plurality of handguns 12'. While FIG. 10 shows a cabinet for four handguns, FIG. 13 differs in that it shows a cabinet for six handguns. Also, in the drawing sheets, FIG. 13 is rotated 90 degrees for ease of placement in the drawings.

Similar to previous embodiments, the cabinet 10" includes a rear housing 14 having a metal rear cover 18 securely connected to the rear housing 14 (e.g., by tamper-resistant fasteners) to prevent authorized entry into the interior of the rear housing 14. A wall mount bracket 20 is provided for securely mounting the cabinet to the wall of any structure. As shown in phantom lines, the cabinet may include optional cabinetry details such as wood or glass walls and front cover to ornamentally display its contents.

As illustrated in FIGS. 10-13, the slots 36 are horizontally aligned and parallel to one another. All slots 36 contain a handgun muzzle end brace 22' movable within the slot 36. A handle 26 and key lock 28 are provided on the rear housing 14 and connected to linkage (not shown) contained within the rear housing 14 for simultaneously locking or unlocking all of the muzzle braces in a manner that will be described.

The rear end braces 24 are provided in the forms of cups 24' and positioned to receive the grip 13' of a handgun when the muzzle of the handgun is captured by the muzzle end brace 22' and in a manner to hold the barrel of the handgun in generally horizontal alignment with the slot 36. As shown, the directions of the muzzle end braces 22' and cups 24' alternate so that when handguns are mounted within the cabinet, they alternate in pointing to the right or the left for more efficient compactness of storage as well as presenting a more appealing display.

Figure 15:
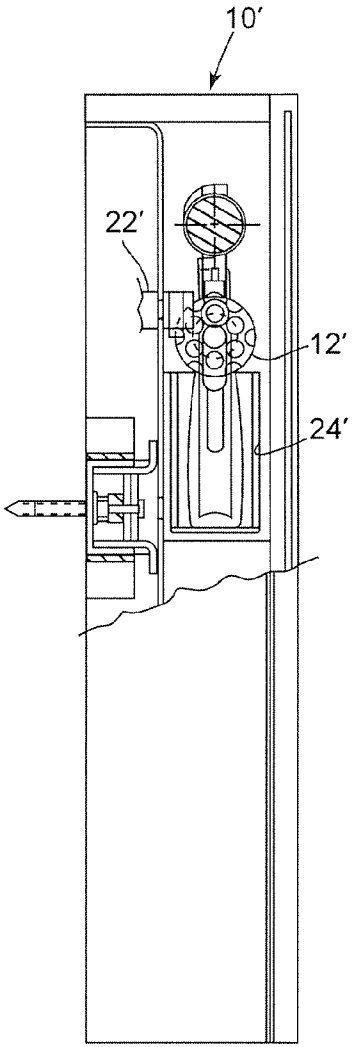
FIG. 15 is a view, shown partially in section, taken along the line 15-15 of FIG. 14.
Figure 16:
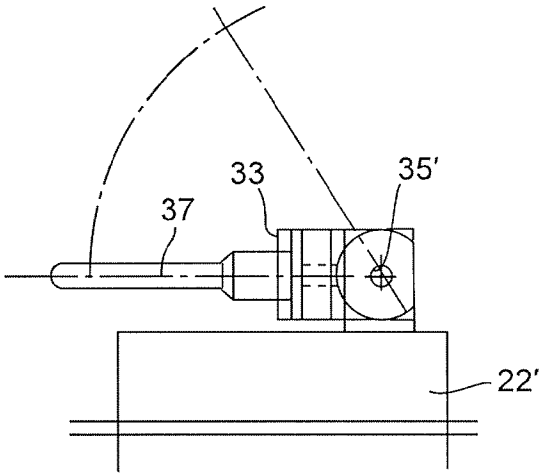
FIG. 16 is a view taken along line 16-16 of FIG. 14.

FIGS. 14-16 show the cabinet 10" of FIG. 10 in greater detail and with stored firearms 12' shown in phantom lines. Various different firearms of different sizes and lengths are shown to illustrate how the muzzle end braces 22' move within their slots 36 to accommodate a pistol barrel length of varying size. Further, the universal ball joint 35' of the muzzle end brace 22' permits a capture member 33 (as will be described) to pivot in multiple directions in the event the firearm 12' is inclined to rest with its barrel at an angle to the axis of the slot 36 when the grip 13' of the pistol is received within the user end brace 24'. The capture member 33 includes a pin 37 sized to be received within the barrel of the firearm so that no portion of the firearm (except for a small portion of the grip) is hidden from view.

As shown in FIGS. 24-35, the various designs of the capture member 33 can permit attachment to the muzzle end brace 22, 22'. A capture member 33 can be uniquely designed to be uniquely adapted for any particular type of firearm.

Figure 24:
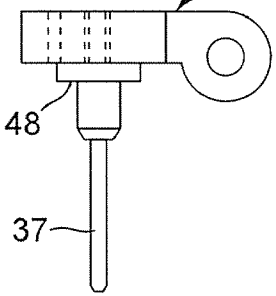
FIG. 24 is a capture member for a mounting bracket with the capture member adapted with a pin to be received within the muzzle of a firearm.

For example, the design of the capture member 33 in FIG. 24 permits a pin 37 to be placed within the muzzle of a pistol or other firearm. A rubber or soft washer 48 provides a non-abrasive contact surface for the end of the muzzle to butt up against the capture member 33. The washer also protects the firearm's muzzle from dust or moisture. The pin 37 can also be lined with a non-abrasive surface to prevent any potential for damage of the muzzle bore from the pin 37.

Figure 26:
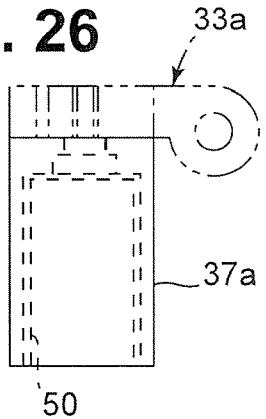
FIG. 26 is an alternative embodiment of the capture member of FIG. 24 having a muzzle cup to be received over the barrel of a rifle or a single barrel shotgun.

FIG. 26, shows a capture member 33*a* with a receiving cup 37*a*. In this design, the end of the muzzle (for example, about 2.5 inches of length) is received within the cup 37*a*. Again, the cup 37*a* can have a soft interior lining 50 to prevent damage to the exterior finish of a single barrel rifle or shotgun.

Figure 27:
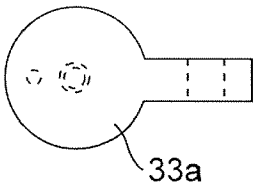
FIG. 27 is a top plan view of the capture member of FIG. 26.
Figure 28:
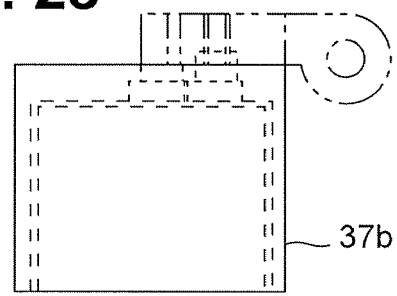
FIG. 28 is a view similar to that of FIG. 26 with an alternative design of the muzzle cup to receive a double-barreled over-under shotgun.
Figure 29:
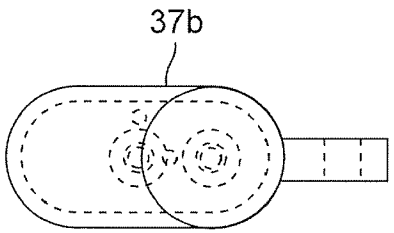
FIG. 29 is a top plan view of the capture member of FIG. 28.
Figure 30:
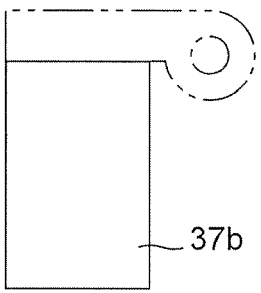
FIG. 30 is a side elevation view of a still further embodiment of a capture member for receiving a double-barreled side-by-side shotgun.
Figure 31:
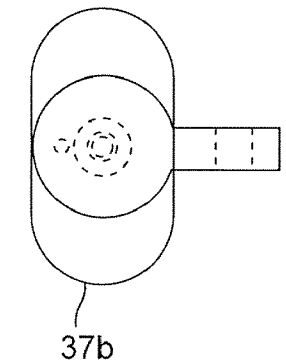
FIG. 31 is a top plan view of the embodiment of FIG. 30.
Figure 34:
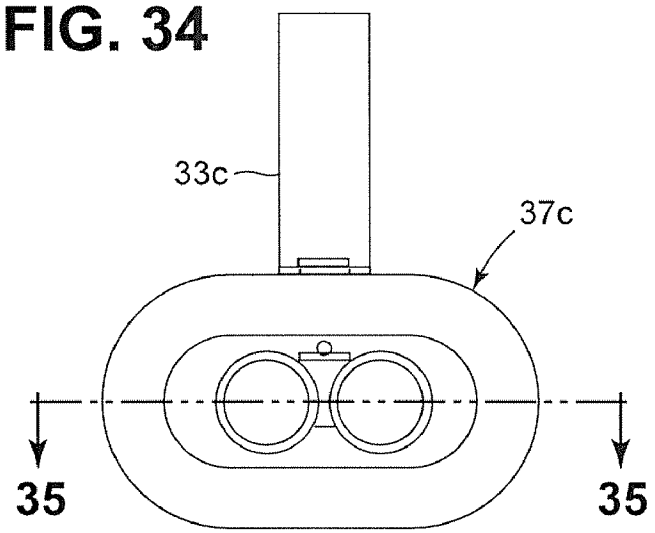
FIG. 34 is a top plan view of the muzzle strap showing use with a side-by-side shotgun.
Figure 35:
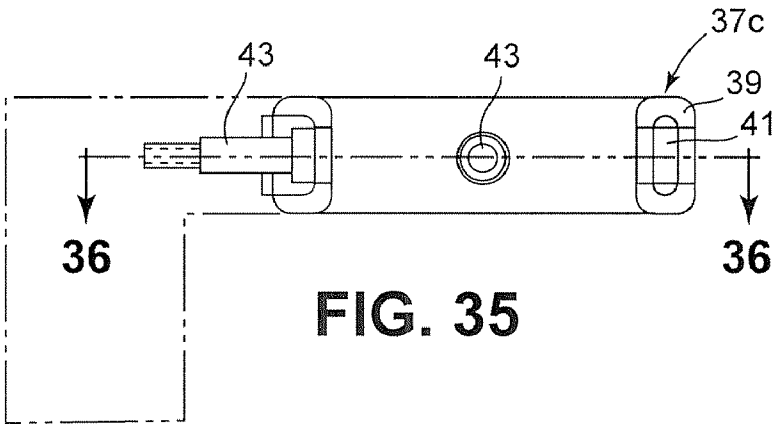
FIG. 35 is a side sectional view of the mounting strap taken along line 35-35 of FIG. 34 with the addition of mounting bolts.
Figure 33:
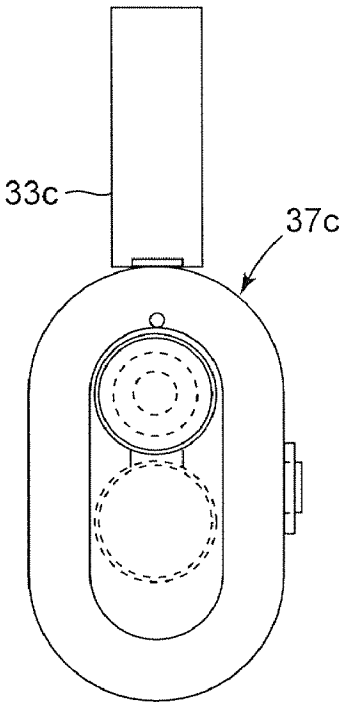
FIG. 33 is a top plan view of a muzzle strap in use over either a single barrel shotgun or rifle or an over-under shotgun.
Figure 32:
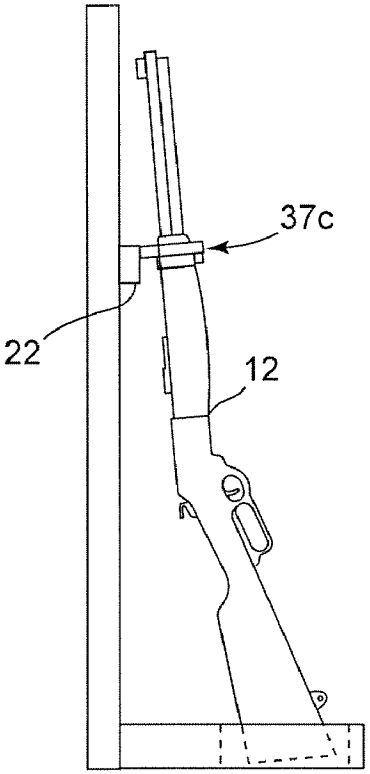
FIG. 32 is a side elevation view of an apparatus according to the invention with a capture member in the form of the muzzle strap.
Figure 36:
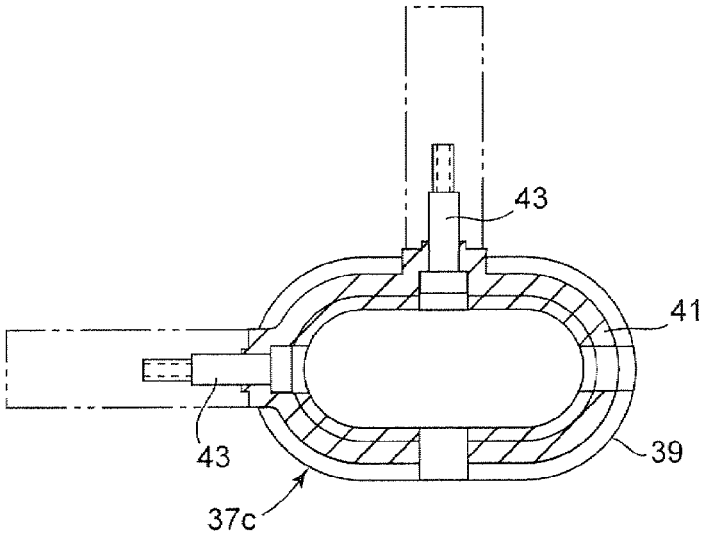
FIG. 36 is a top sectional view of the muzzle strap taken along line 36-36 of FIG. 35.

The designs of FIGS. 29-31 are of similar construction to that of FIGS. 26-27 except that the cup 37*b* is elongated in an oval shape to receive a double-barreled firearm within the interior of the cup 37*b*. The designs of FIGS. 30-31 accommodate a double-barreled side-by-side firearm while the designs of FIGS. 28-29 accommodate a double-barreled over-under firearm.

Figure 17:
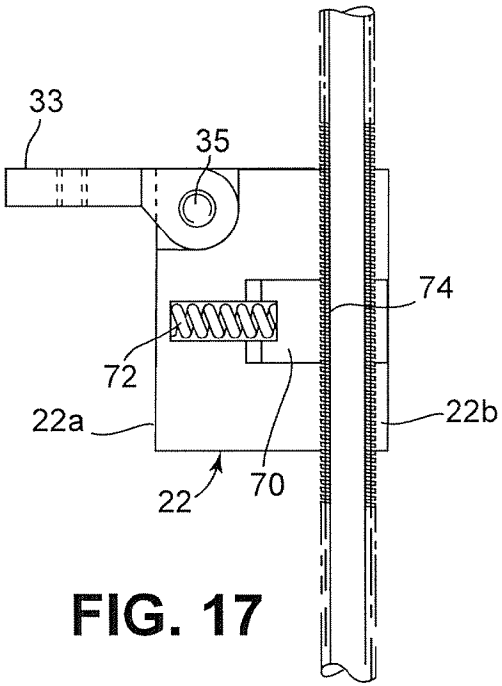
FIG. 17 is a side sectional view of a locking muzzle bracket shown partially in section and carried on a threaded shaft.
Figure 25:
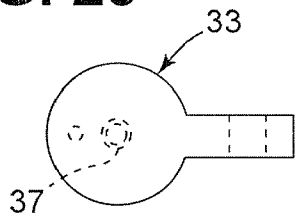
FIG. 25 is a top plan view of the capture member of FIG. 24.

In each of the designs of FIGS. 26-31, the cup 37*a*, 37*b* is sized so that there is little play of the end of the muzzle within the cup 37*a*, 37*b* and the muzzle of the firearm can be slid axially in and out of the cup 37*a*, 37*b*. In the design of FIGS. 24-25, the pin 37 is sized to be received within the bore of the firearm and the firearm can be moved axially to the pin 37. In all of the designs of FIGS. 24-31, the capture member is mounted to the muzzle bracket by a pivot pin 35 (FIG. 17) to permit pivoting about an axis, which is perpendicular to the direction of the slots 36. As described, the pivot pin 35 may be substituted with a ball joint 35' (FIG. 16) or other joint.

The design of FIGS. 32-35 illustrates a universal capture member 33*c* having a muzzle strap 37*c*. The strap 37*c* is generally elongated in shape and includes a molded foam pad 39 surrounding a metal core 41. Attachment bolts 43 attach the muzzle strap 37*c* to the muzzle end brace 22 in one of two orientations illustrated in FIGS. 33 and 34 to accommodate either a side-by-side or an over-under double-barreled shotgun.

The muzzle strap 37*c* need not pivot on the muzzle end brace 22 and need not have a tight tolerance since the muzzle end brace 22 can simply be lifted (with reference to the view of FIG. 32 and in a manner as will be described) to clear the end of the muzzle. It will be appreciated that since the muzzle strap 37*c* need not be placed at the discharge end of the firearm, the concept of muzzle end shall include placement on the muzzle distant from the user end (i.e., the butt end) of the firearm.

With reference to FIGS. 17-21, the first locking member of the present invention will now be described. As shown in FIGS. 17-21, the muzzle end brace 22 is a block of metal having an exposed side 22*a* positioned on an exterior surface of a front wall 58 of the rear housing 14. A hidden side 22*b* is positioned within the rear housing. Edges 58*a* of the front wall 58 define the slots 36. These edges 58*a* are fitted into side slots formed in the sides of the block of the muzzle end brace 22. As a result, the muzzle end brace 22 can slide along the direction of the slot 36. It will be appreciated that the muzzle end brace may be split on a plane coincident with the plane of front wall 58 and joined by hidden screws, or may be a single integral part as shown.

In the embodiment shown, the capture members are pivotally connected to the exposed sides 22*a* by a pivot pin 35. Any one of the designs of the capture member 33 shown in FIGS. 24-31 can be used on the capture member to accommodate a wide variety of firearms. Also, the universal muzzle strap shown in FIGS. 32-36 can be attached directly to the exposed side 22*a* without the need for a pin.

The hidden side 22*b* has a smooth bore 66 extending through the hidden side 22*b* in a direction parallel to the slot 36. A threaded rod 42 extends through the bore 66.

In the embodiment shown in FIGS. 17-21, the rod 42 is shown as having a helical thread along its length but with unthreaded flats 68 formed on one side of the rod 42. As will become apparent, the flat 68 is used in a locking design in which all firearms within a cabinet may be simultaneously locked and unlocked. In alternative designs, as will be described, where only a single firearm is to be locked or unlocked without the option for a gang lock or unlock, the threaded rod 42 need not have the flats 68.

A pawl 70 is provided in the form of a block received within a hole formed within the muzzle brace 22. The pawl 70 is aligned relative to the rod 42 to move radially toward or away from the rod 42. A spring 72 urges the pawl 70 towards the threaded rod 42.

The pawl 70 has a locking surface 74 opposing the threaded rod 42. The locking surface 74 has a female threaded profile to match the male threaded profile of the threaded rod 42. The bias of the spring 72 urges the pawl 70 radially toward the threaded rod 42. The threads of the pawl 70 engage the threads of the rod 42 to prevent axially movement of the muzzle end brace 22 on the rod 42.

In the embodiments shown in FIGS. 17-21, the pawl 70 and mounting brace 22 are not provided with an individual lock assembly to move the pawl 70 away from the threaded rod 42. Instead, that optional embodiment will be separately described.

Figure 20:
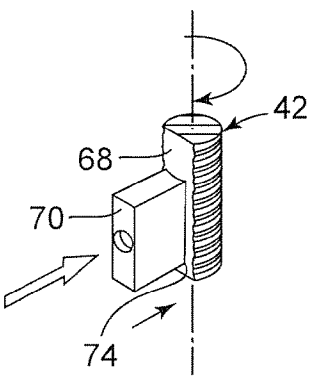
FIG. 20 is the view of FIG. 19 showing the bracket and shaft in an unlocked position.
Figure 19:
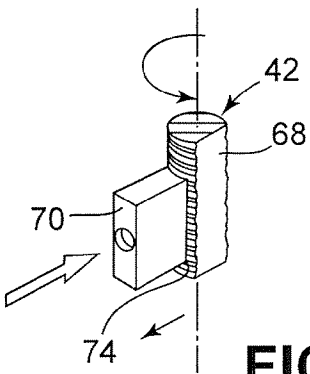
FIG. 19 is a perspective view of a muzzle bracket and shaft of FIG. 17 shown in a locked position.

With reference to FIGS. 19 and 20 it will be noted that when the rod is oriented with its threaded portions facing the pawl, the threads of the pawl 70 mate with the threads of the rod 42 to prevent axial movement of the pawl 70. This prevents axial movement of the mounting end brace 22 relative to the rod 42.

In the event the rod 42 is rotated 90 degrees about its axis, the threaded surface 74 of the pawl 70 is opposing a flat surface 68 of the rod 72. With such an alignment, the pawl 70 may slide on the rod 420 and muzzle brace 22 may move axially on the rod 28.

Rotational movement of the rod 42 to a position with the flats 68 opposing the pawl 70 is an unlocked position (or state) for the muzzle end brace 22 to move axially on the rod 42 and to release a captured muzzle end of a firearm. When the muzzle end brace 22 is positioned with the brace in a capture state on the muzzle end of a firearm, the rod 42 may be rotated 90 degrees with its threads opposing and mating with the threads of the pawl 70. The muzzle brace 22 is then restrained from axial movement and the muzzle end brace 22 securely captures the muzzle end of the firearm.

Figure 21:
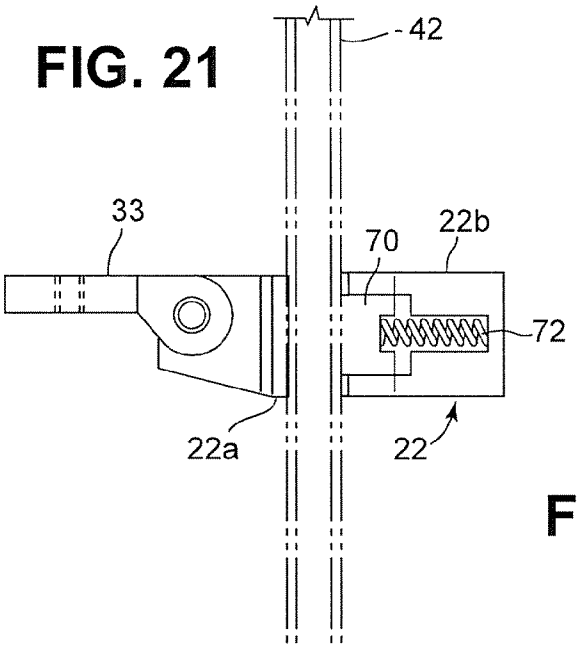
FIG. 21 is an alternative embodiment of the muzzle bracket and shaft arrangement of FIG. 17.

FIG. 21 shows an alternative design where the pawl 70 and spring 72 are contained within the hidden side 22*b* of the muzzle brace 22. Upon description of the individual locking members for the muzzle and braces, as will be described, it will be appreciated that the preferred design for use with an individual locking member is the design of FIGS. 19 and 20.

Figure 37:
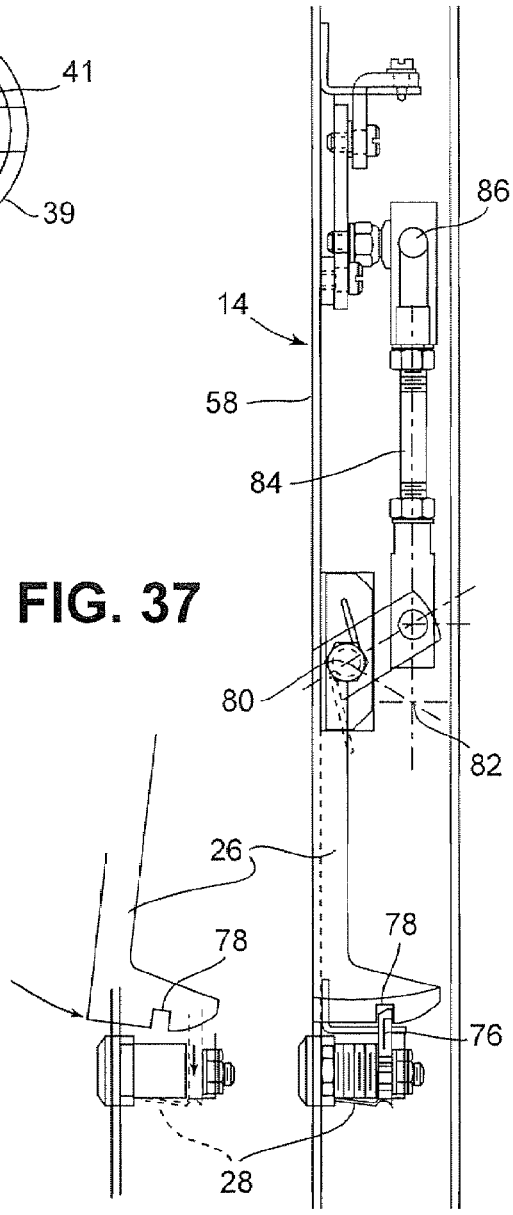
FIG. 37 is a side elevation view of elements of a linkage assembly for rotating multiple locking members in the cabinet.
Figure 38:
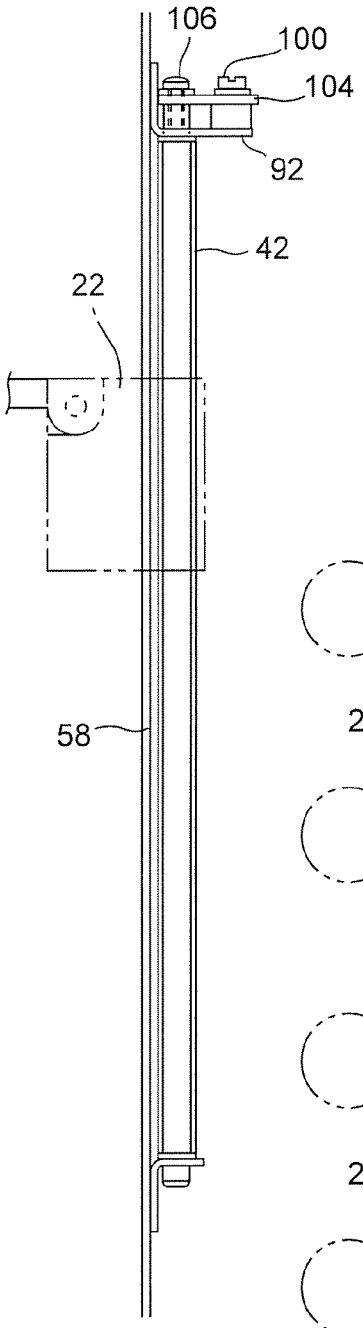
FIG. 38 is a side elevation view of a locking member coupled to the linkage of FIG. 37.
Figure 39:
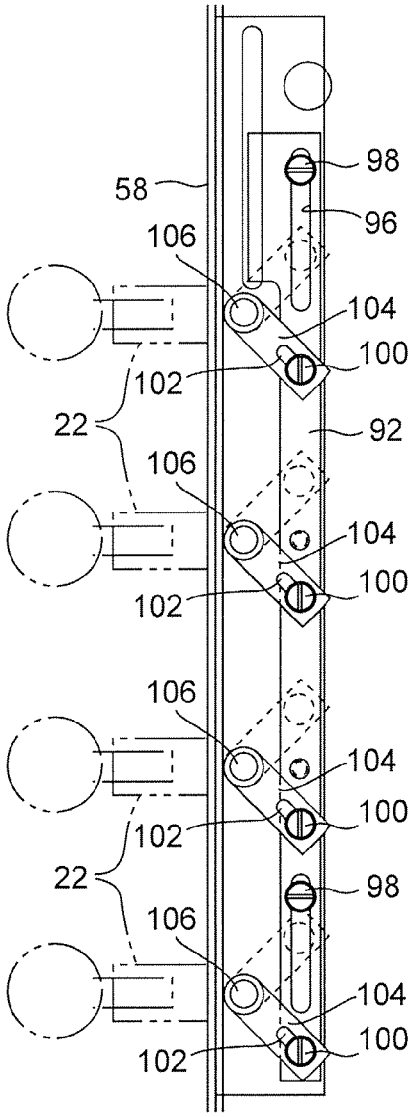
FIG. 39 is a top plan view of linkage elements.
Figure 40:
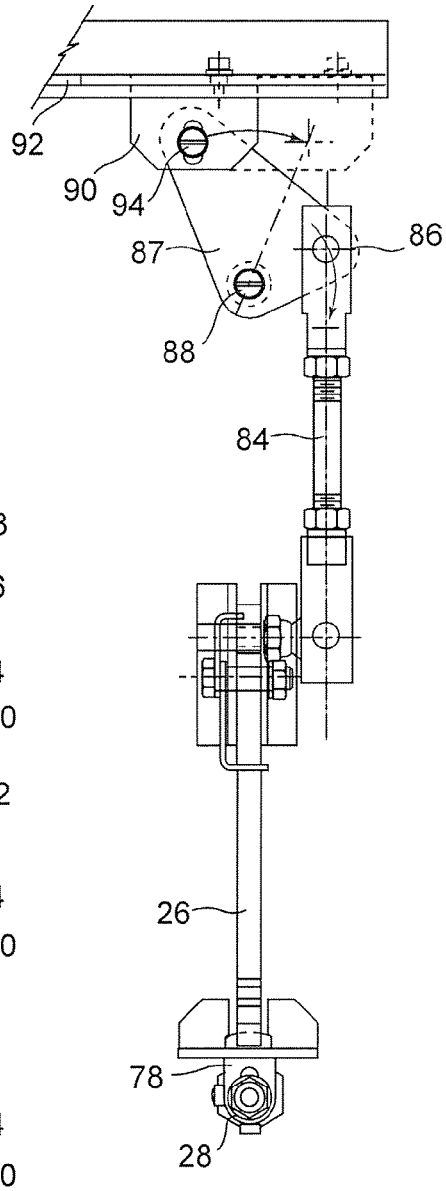
FIG. 40 is a rear plan view of the link elements of FIG. 37.

FIGS. 37-40 illustrate an actuator for rotating the threaded rods 42 ninety degrees between the locked position of FIG. 19 and unlocked position of FIG. 20. FIG. 37 illustrates the latching handle 26 and key lock 28 in two positions. Upon turning of the key (not shown) in the key lock 28, a key cam 76 is removed from a receiving slot 78 of the handle 26 permitting the handle to be lifted out of the rear housing 14.

The handle 26 pivots around a pivot point 80 with a lever end 82 drawing an adjustable connecting rod 84 downward (in the view of FIG. 37). An upper end of the connecting rod 84 has a ball joint upper end 86, which, connects to a crank arm 87 which pivots around a pivot point 88. The crank arm is connected by a bracket 90 to a transfer bar 92 at a pivot joint 94. Lifting of the handle 26 causes the transfer bar 92 to shift to the right (in the view of FIG. 40).

The transfer bar 92 has two slots 96 which confine the motion of the transfer bar linearly along its longitudinal axis. Each of the slots 96 contains a shoulder bolt 98 for permitting adjustment of position of actuation. A plurality of cam bolts 100 are fixed to the transfer bar 92. Each of the cam bolts 100 is further contained within a slot 102 of a lever arm 104. Each of the lever arms 104 is connected to an individual one of the threaded rods 42 by an attachment bolt 106.

As the transfer bar 92 moves to the right (with reference to FIG. 40 or downward with reference to FIG. 39), the lever arms 104 are pivoted clockwise (in the view of FIG. 39) causing the threaded rods 42 to pivot 90 degrees to a position which is an unlocked position with the flats 68 opposing the pawl 70. Returning the latching handle 26 to its recessed position shown in FIG. 37 causes the transfer bar 92 to move to the left (with reference to the view of FIG. 40) (or upward with reference to the view of FIG. 39) causing the lever arms 104 to pivot 90 degrees counterclockwise returning the threaded rods 42 to the locked position with the threads of the rod 42 opposing and mating with the threads of the pawl 70.

As a result of the apparatus thus described, moving the handle 26 to a locked position recessed within the rear housing 14 causes a simultaneous locking of all muzzle end braces 22, 22'. Lifting the handle 26 causes simultaneously unlocking of all the muzzle end braces 22, 22'.

In certain installations, it may be desirable to have a muzzle brace 22 be individually unlocked. Such an option may be used in combination with a gang lock and unlock operation as described or may be used in a cabinet which does not have a gang locking option.

Figure 23:
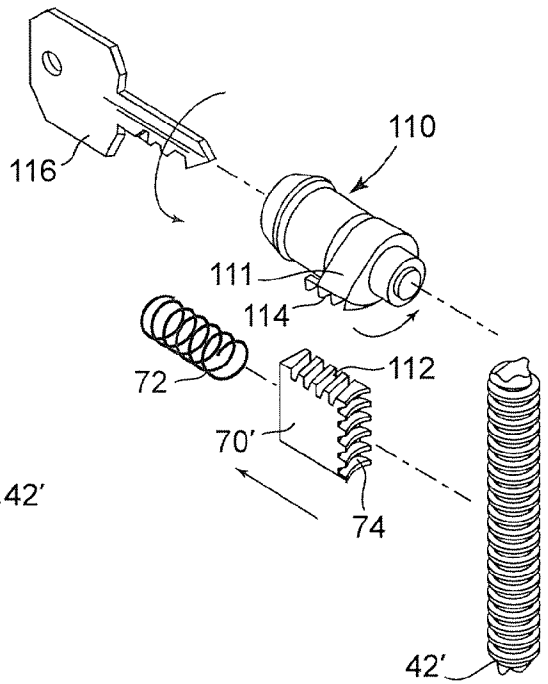
FIG. 23 is an exploded perspective view of the apparatus of FIG. 22.
Figure 22:
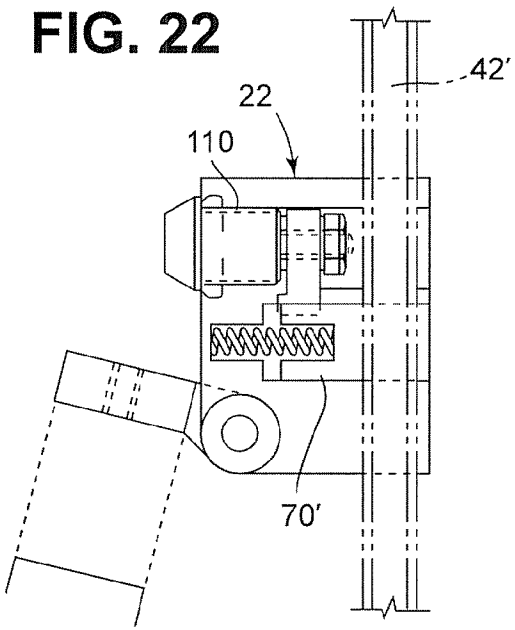
FIG. 22 is a side elevation view of a muzzle bracket and shaft similar to that of FIG. 17 showing an embodiment provided with a front facing lock.

An individual locking system or second lock member is shown with reference to FIGS. 22 and 23. In this embodiment, the threaded shaft 42' is positioned relative to the slots 36 as previously described.

In the embodiments of FIGS. 22 and 23, the shaft is not rotating and the linkage described with reference to FIGS. 37-40 is eliminated or not activated. Further, the threaded shaft 42' need not provided with flats 68. Instead, shaft 42' may be threaded throughout its length. It will be appreciated that in all of the embodiments thus described, the threads on the shaft 42, 42' do not need to be helical threads but could simply be circular flanges. Further, it will be appreciated that while FIGS. 22-23 do not show a rotating threaded rod 42 with flats 68, the non-rotating rod 42' could be replaced with a rotating rod 42 having flats 68 to have the combined option of both a gang lock and an individual lock for firearms contained within a cabinet.

In FIGS. 22, 23, the muzzle end brace 22 is provided with an internal lock 110. The lock 110 is positioned above the pawl 70'. An opposing surface of the pawl 70' is provided with a helical threaded surface 112. The lock 110 contains a cam 111 having a threaded edge 114 which mates with the threaded surface 112. The cam 110 rotates upon turning an authorized key 116 within the lock 110.

A spring 72 biases the pawl 70' against the threaded rod 42' as in the previously described embodiment. When the cam 111 is rotated by the key 116 to engage the threaded surface 112, the cam 111 urges the pawl 70' against the bias of the spring 72 away from threaded engagement with the rod 42'. As a result of the disengagement of the pawl 70' from the shaft 42', the muzzle end brace 22 is unlocked and can be freely moved axially along the direction of the shaft 42'.

Figure 41:
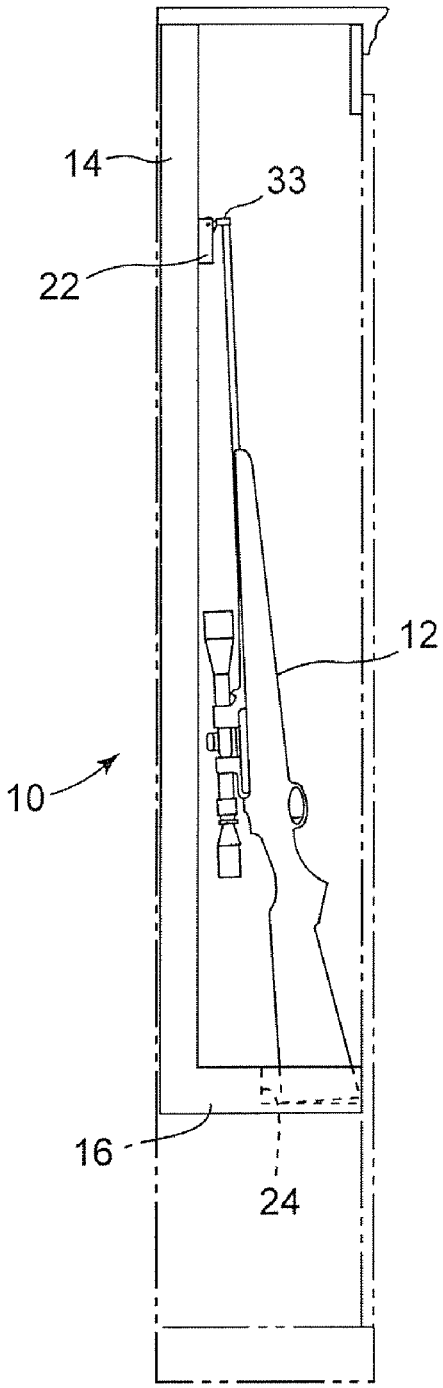
FIG. 41 illustrates a rifle secured in an apparatus according to the present invention.

FIGS. 41-44 illustrate various concepts and sequence of operations of the present invention. In FIG. 41, a rifle is contained within the cabinet 10 with the butt of the firearm 12 disposed within the butt pocket or user end brace 24.

The muzzle end brace 22 is provided with any desired capture member such as that shown in FIG. 24 for capturing the muzzle end of the firearm. The muzzle end brace 22 may be gang locked as described with reference to FIGS. 37-40 or individually locked as described with reference to FIGS. 22 and 23 or both.

Figure 42:
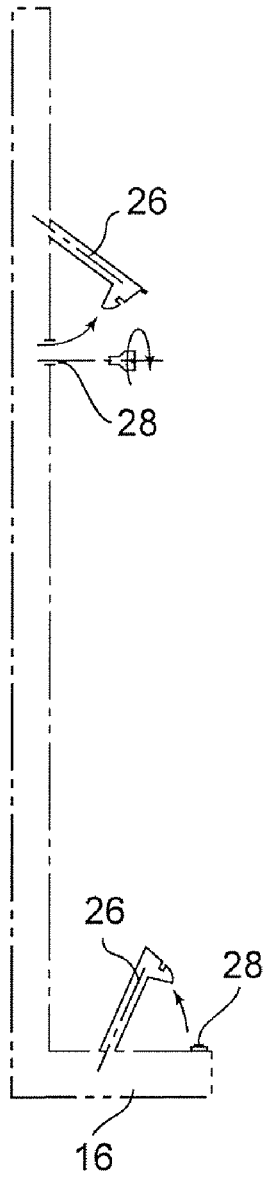
FIG. 42 illustrates optional placements of a lock handle for locking and unlocking all firearms stored in the cabinet.
Figure 43:
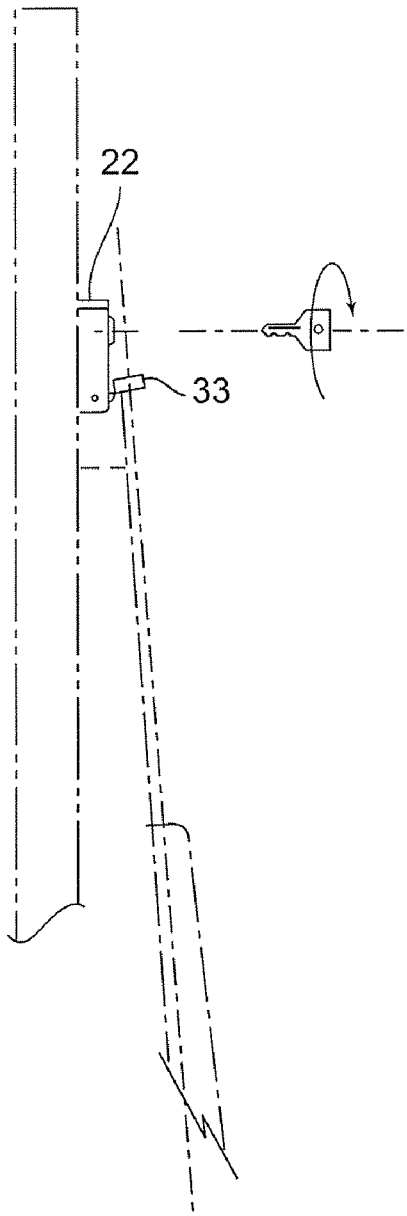
FIG. 43 illustrates an individual lock option for removing a single firearm from the cabinet.

FIG. 42 shows a number of different alternative options (without intending to be limiting) of placement of the handle 26 on either the rear housing 14 or base member 16 to be operated by key in a key lock 28 to release or lock all of the firearms within the cabinet 10. FIG. 43 illustrates an individual lock option (which may be used alone or in combination with a gang lock option) where a key is provided into the lock 110 of an individual muzzle brace 22.

Regardless of the mechanism by which the muzzle end brace 22 is unlocked (i.e., either gang locked or individually locked), the muzzle end brace 22, once unlocked, can be slid upwardly on the threaded rod 42, 42' permitting the user end (e.g., rifle butt 13) to be removed from the user end brace 24 by having the butt of the firearm clear the pocket in base member 16.

Figure 44:
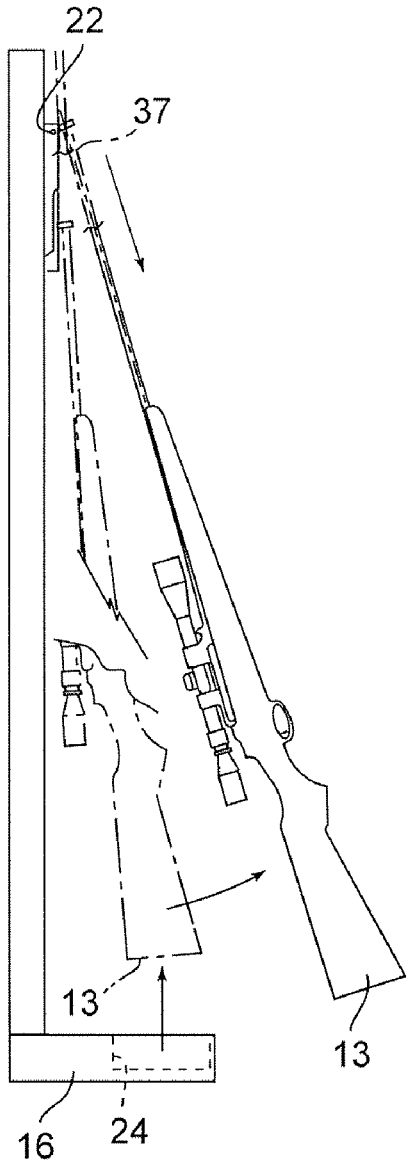
FIG. 44 illustrates a sequence of operation for removing a firearm from the cabinet.

The pivoting of the capture member 33 on the muzzle end brace 22 permits the firearm 12 to be swung away from the rear housing 14 (shown in solid lines in FIG. 44) in which case the firearm can be removed from the capture member (in the case of FIG. 44 by slipping the firearm from the security pin 37). To return a firearm to storage, the procedure is reversed.

From the forgoing description, it has been shown how a firearm storage apparatus can be provided which can accommodate one of a plurality of firearms to securely fasten the firearms to the apparatus. Further, the invention permits fastening the firearms to the apparatus in such a manner that decorative cabinets can be built around the apparatus in a manner to display the firearms with as much ornamentation as desired by a user.

The apparatus can accommodate a wide variety of firearms including long firearms such as shotguns and rifles having butts for placement against a shoulder of the user or for hand held weapons such as pistols having pistol grips. Different types of muzzles can be provided for including double-barreled shotguns of various geometries.

Various options are possible for locking the firearms. These options include mechanisms for locking firearms individually, gang locking all firearms within the cabinet or a combination of both systems. The mechanisms for unlocking the firearms can be by hand operated lever, or power operated systems such as electric motor driven linkages or the like or remote control and may include electronic alarms indicating actuation of the systems.

Different mechanisms are provided for retention of the barrel including a muzzle pin, muzzle cup and barrel strap as previously described. Safety rods may also be provided for blocking the firing chamber to ensure a firearm is not loaded.

Figure 45:
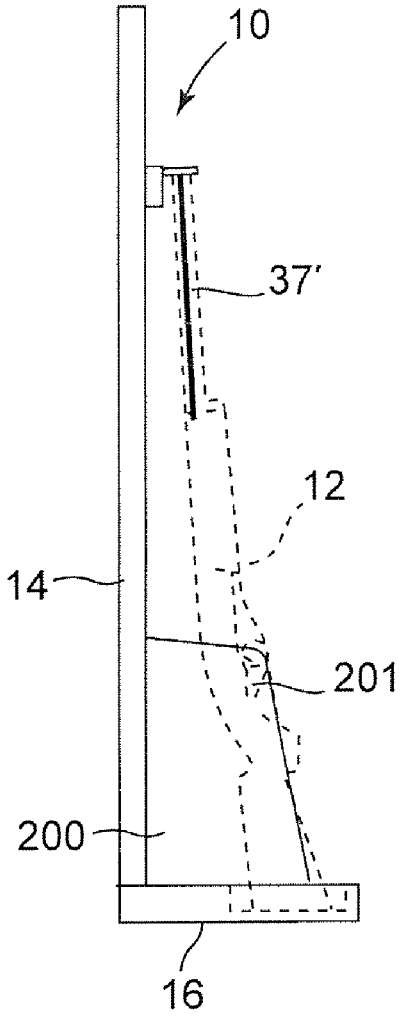
FIG. 45 is a side view similar to that of FIG. 2 showing an embodiment with an elongated muzzle pin.
Figure 46:
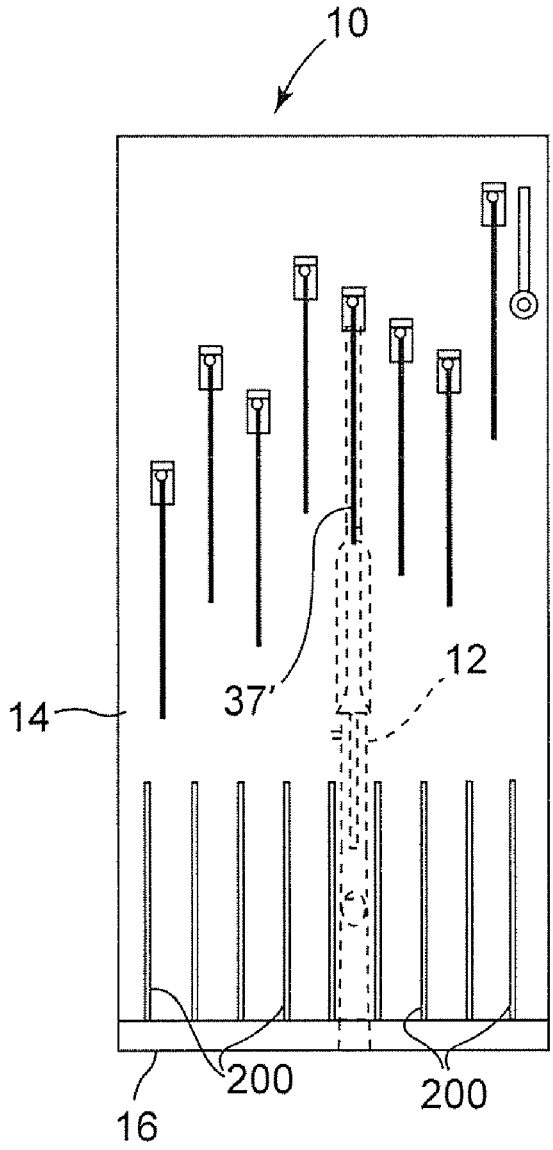
FIG. 46 is a front elevation view of the cabinet of FIG. 45.

FIGS. 45 and 46 illustrate a cabinet 10 modified with an elongated safety pin 37'. Selected to meet the safety requirements that a firearm should be protected from removal even if a thief cuts a barrel or stock, the pin 37' is sized to extend into the length of the barrel. The pin 37' can function as the safety rod referenced above and extend into the firing chamber. To resist theft by sawing through a rifle barrel, the pin 37' is hardened steel selected to resist cutting by hacksaw or the like.

In a further embodiment, the pin 37' can be provided with a plurality of annular grooves spaced along its length. Hardened steel can resist cutting but can be somewhat brittle. The grooves enable a user to adjust the length of the pin 37' by breaking off sections of the pin 37'.

A stock shield 200 protects theft resulting from sawing through a stock of a firearm. A plurality of shields 200 are provided in the form of steel plates permanently attached to the base 16 and extending outwardly from the rear housing 14 to protect the vulnerable stock of the firearm 12. A shield 200 is provided between each stored firearm. The shield 200 is sized to cover the area occupied by the firearm 12 up through the trigger mechanism 201 (FIG. 45). If a determined thief sawed through the firearm 12 above the shield 200, he would render the gun unusable. The shields 200 also perform dual functions. When installed, they take the place of the gusset 40 in the embodiment of FIG. 5.

Having described the present invention in a preferred embodiment, it will be appreciated that modifications and equivalents may readily occur to one skilled in the art. It is intended that such modifications and equivalents shall be included within the scope of the claims, which are appended hereto. For example, an optional safety rod may be added that occupies the firearm's firing chamber and eliminates the possibility of a round of ammunition in the chamber and potential for accidental discharge.

We claim:

1. An apparatus for securely storing a plurality of firearms, each of said firearms having a muzzle end and a user end, said apparatus comprising:

a plurality of firearm braces including:

a plurality of muzzle end braces 22 adapted to capture a muzzle end of a firearm;

a plurality of user end braces 24 adapted to capture a user end of a firearm;

selected ones of said user end braces 24 associated with selected ones of said muzzle end braces 22 to define a plurality of associated pairs of said firearm braces;

a plurality of firearm storage sites defined between each of said associated pairs of firearm braces 22, 24, said firearm storage sites having a longitudinal direction between said muzzle end braces 22 and said user end braces 24;

at least one of said user end brace 24 and said muzzle end brace 22 of each of said associated pairs of braces being a locking brace shiftable between a capture state and a disengage state;

in said capture state, said locking brace engaging a firearm in said storage pathway in a manner to resist movement of said firearm from said storage pathway;

in said disengage state, said locking brace permitting movement of said firearm from said storage pathway;

a plurality of first lock members associated with each of said locking braces, each of said first lock members shiftable between a locked position and an unlocked position;

in the locked position, said first lock member engaged with said locking brace to interfere with shifting of said locking brace from said capture state to said disengage state;

in the unlocked position, said first lock member positioned to permit shifting of said locking brace from said capture state to said disengage state;

a common actuator operably connected to each of said first lock members to shift each of said first lock members between said locked and unlocked positions upon actuation of said common actuator by an operator;

a plurality of second lock members associated with each of said locking braces, each of said second lock members movable between a locked state and an unlocked state when said first lock member is in said locked position;

in the locked state, said second lock member engaged with said locking brace to interfere with shifting of said locking brace from said capture state to said disengage state;

in the unlocked state, said second lock member positioned to permit shifting of said locking brace from said capture state to said disengage state.

2. An apparatus according to claim 1 wherein at least one of said user end brace and said muzzle end brace is a displaceable brace movable along an associated firearm storage site.

3. An apparatus according to claim 2 wherein said locking brace is said displaceable brace.

4. An apparatus according to claim 1 wherein said muzzle brace is said locking brace.

5. An apparatus according to claim 4 wherein said user end brace is a displaceable brace movable along an associated firearm storage site to accommodate firearms of varying lengths.

6. An apparatus according to claim 1 wherein:

said first lock members are longitudinal members;

each of said longitudinal members secured to a frame to be rotatable about a respective one of a plurality of longitudinal axes between said locked and unlocked positions;

a linking connecting said common actuator to each of said first lock members to rotate each of said first lock members about said axis upon said actuation of said common actuator by said operator.

7. An apparatus according to claim 6 wherein:

each of said locking braces has a brace locking surface which mates with a mating surface on said first locking member when said first locking member is in said locked state;

said mating surface and said brace locking surface disposed to move out of mating relation when said first locking member is shifted to said unlocked position said brace locking surface of each of said second lock members movable away from said mating surface when said second lock member is in said unlocked state and when said first lock member is in said locked state.

8. An apparatus for securely storing at least one firearm, said firearm having a muzzle end and a user end, said apparatus comprising:

a locking brace adapted to capture and retain said firearm, said locking brace shiftable between a capture state and a disengage state;

in said capture state, said locking brace engaging a firearm in a manner to resist removal of said fireman;

in said disengage state, said locking brace permitting removal of said firearm;

a first lock member rotatable about an axis between a locked position and an unlocked position;

in the locked position, said first lock member engaged with said locking brace to interfere with shifting of said locking brace from said capture state to said disengage state;

in the unlocked position, said first lock member positioned to permit shifting of said locking brace from said capture state to said disengage state;

a second lock member movable between a locked state and an unlocked state when said first lock member is in said locked position;

in the locked state, said second lock member engaged with said locking brace to interfere with shifting of said locking brace from said capture state to said disengage state;

in the unlocked state, said second lock member positioned to permit shifting of said locking brace from said capture state to said disengage state;

said locking brace having a brace locking surface which mates with a mating surface on said first locking member when said first locking member is in said locked state;

said brace locking surface and said mating surface disposed to move out of mating relation when said first locking member is shifted to said unlocked position;

said brace locking surface movable away from said mating surface when said second lock member is in said unlocked state and when said first lock member is in said locked state.

9. An apparatus according to claim 7 wherein said locking brace is adapted to capture a muzzle end of a firearm.

10. An apparatus according to claim 7 comprising:

a plurality of said locking braces for securely retaining a plurality of firearms;

a plurality of first lock members associate with each of said locking braces;

a common actuator operably connected to each of said first lock members to shift each of said first lock members between said locked and unlocked positions upon actuation of said common actuator by an operator.

11. An apparatus according to claim 10 comprising a plurality of said second lock members associate with each of said locking braces.

12. An apparatus for securely storing at least one firearm, said firearm having a muzzle end and a user end, said apparatus comprising:

a locking brace adapted to capture and retain said firearm, said locking brace shiftable between a capture state and a disengage state;

in said capture state, said locking brace engaging a firearm in a manner to resist removal of said firearm;

in said disengage state, said locking brace permitting removal of said firearm;

an individual lock member movable between a locked state and an unlocked state;

in the locked state, said individual lock member engaged with said locking brace to interfere with shifting of said locking brace from said capture state to said disengage state;

in the unlocked state, said individual lock member positioned to permit shifting of said locking brace from said capture state to said disengage state;

said locking brace having a brace locking surface biased to mate with a mating surface on a cooperating fixed member;

said brace locking surface movable away from said mating surface when said individual lock member is in said unlocked state;

a gang lock member rotatable about an axis between a locked position and an unlocked position;

in the locked position, said gang lock member engaged with said locking brace to interfere with shifting of said locking brace from said capture state to said disengage state;

in the unlocked position, said gang lock member positioned to permit shifting of said locking brace from said capture state to said disengage state;

said individual lock member adapted to be operable when said first gang member is in said locked position.

* * * * *